United States Patent [19]

Hasman

[11] 4,133,822

[45] Jan. 9, 1979

[54] HYDROGENATION OF UNSATURATED FATTY ACID

[75] Inventor: John M. Hasman, Berea, Ohio

[73] Assignee: SCM Corporation, New York, N.Y.

[21] Appl. No.: 815,157

[22] Filed: Jul. 13, 1977

[51] Int. Cl.[2] ..... C11C 3/12

[52] U.S. Cl. ..... 260/409; 260/97.5

[58] Field of Search ..... 260/409, 97.5

[56] References Cited

U.S. PATENT DOCUMENTS

| | | | |
|---|---|---|---|
| 2,307,065 | 1/1943 | Paterson | 260/409 |
| 2,413,009 | 12/1946 | Taussky | 260/409 |
| 3,271,410 | 9/1966 | Cagneron | 260/409 |
| 3,674,821 | 7/1972 | Gooding | 260/409 |

OTHER PUBLICATIONS

Bailey's Industrial Oil and Fat Products, 3rd Ed., pp. 793–794, (1964).

*Primary Examiner*—John Niebling
*Attorney, Agent, or Firm*—Jerry K. Mueller, Jr.

[57] ABSTRACT

Unsaturated fatty acids refractory towards hydrogenation are rapidly and efficiently hydrogenated in the presence of nickel hydrogenation catalyst and of copper chromite adjunct catalyst with otherwise reasonably mild hydrogenation conditions.

14 Claims, No Drawings

HYDROGENATION OF UNSATURATED FATTY ACID

BACKGROUND OF THE INVENTION

This invention relates to a process for catalytically hydrogenating unsaturated fatty acids and more particularly to accomplishing this in rapid fashion under reasonably mild hydrogenation conditions.

Unsaturated fatty acids are refractory towards hydrogenation and typically require extreme high temperature, extreme high pressure, protracted hydrogenation time or combinations thereof in order to satisfactorily hydrogenate them. Conventionally, unsaturated fatty acids are hydrogenated with hydrogen gas in the presence of at least 0.2 to 0.5% nickel hydrogenation catalyst and usually more at temperatures in excess of 150° C. under pressures of at least 200 to 300 psig and more often 600 to 1000 psig and higher. Times of at least 6 to 8 hours or more normally are required in order to satisfactorily hydrogenate the fatty acids. By contrast, hydrogenation of glyceride oils (which generally are not refractory towards hydrogenation) typically can be accomplished in relatively short times at about 100° to 260° C. at pressures of around 0 to 100 psig. Fatty acids, then, are adjudged to be refractory towards hydrogenation by comparison and contrast to glyceride oils. Hydrogenation of fatty acids and glyceride oils is outlined in *Bailey's Industrial Oil and Fatty Products,* 3rd Edition, Pages 719-896 (Interscience Publishers, New York, New York, 1964), the same being expressly incorporated herein by reference.

SUMMARY OF THE INVENTION

The present invention is a process for the catalytic hydrogenation of unsaturated fatty acids refractory towards hydrogenation with hydrogen gas in a hydrogenation zone under hydrogenation conditions. Broadly, such process comprises conducting said hydrogenation in the presence of about 0.025 to about 0.3 weight percent nickel hydrogenation catalyst and of about 0.5 to about 3 weight percent copper chromite adjunct catalyst. Hydrogenation conditions comprise a temperature of at least about 150° C. and a gauge pressure of at least about 40 psi. The resulting hydrogenated fatty acid then is withdrawn from the hydrogenation zone.

DETAILED DESCRIPTION OF THE INVENTION

Of importance in the present invention is that both the nickel hydrogenation catalyst and the copper chromite adjunct catalyst are established and maintained simultaneously in the hydrogenation zone during the hydrogenation reaction. The nickel hydrogenation catalyst is present in a proportion of about 0.025 to about 0.3 weight percent based on the weight percent of the fatty acid in the zone and the adjunct catalyst is present in a proportion of about 0.5 to about 3 weight percent upon the same basis. Surprisingly, it was determined that such small quantity of nickel catalyst (small relative to the quantities heretofore proposed in this art) effectively and rapidly catalyzed the hydrogenation of unsaturated fatty acids by the addition thereto of a moderate proportion of copper chromite adjunct catalyst. This is especially surprising because it is known that copper chromite catalyst do not strongly catalyze even glyceride oils and are able to produce a hydrogenated glyceride oil product having an IV only as low as about 100 under conventional glyceride oil hydrogenation conditions. In the present process, product hydrogenated fatty acids suitably can have an Iodine Value moderately lower than the IV of the feed fatty acid and such IV can range as low as about 0 to 5. Of course, the IV of the product hydrogenated fatty acid in part depends upon the IV of the fatty acid fed to the process. Feed fatty acids for the present process suitably can have an Iodine Value, for example, as low as 10 to 15 and as high as 130 to 140 and higher, depending in large part upon the source from which the fatty acids were derived. More on this will follow later herein.

Regardless of the initial IV of the feed fatty acid and the source from which such feed fatty acid was derived, practical and efficient hydrogenation can be obtained in the present process under relatively mild hydrogenation conditions, which is a decided benefit to the process. One need only establish hydrogenation conditions conventionally used in the glyceride oil hydrogenation field in order to satisfactorily hydrogenate fatty acids by the instant process. Consequently, hydrogenation pressure of at least about 40 psig and typically ranging from about 40 to 100 psig is all that is needed in the present process. While the present process also works extremely well at higher pressures, for example about 200 to 300 psig, the increase in the rate of hydrogenation and corresponding decrease in hydrogenation time always does not justify the use of such high hydrogenation pressures. Also, the hydrogenation temperature need only be above about 150° C. and generally this will be from about 150° C. to about 300° C.

The nickel hydrogenation catalyst can be in supported or unsupported form. Typical support materials include, for example, alumina, silica gel, activated carbon and the like. The nickel catalyst can be made by thermally decomposing nickel formate or other heat-labile nickel salt in fatty oil at about 218° to 232° C. or by precipitating a nickel salt on an inert carrier followed by a reduction with hydrazine or hydrogen gas. The nickel catalyst also can be prepared by the treatment of electrolytically precipitated nickel hydroxide which may be prepared by passing direct current through a cell using nickel as the anode and using the dilute solution of an alkali salt to the weak acid as an electrolyte. The nickel hydroxide so prepared may be conventionally reduced, such as, in the presence of hydrogen gas or hydrazine. The nickel catalyst also may be promoted as is conventional in this field. The particular manner used in preparing the nickel hydrogenation catalyst is not critical to the present invention as the present invention employs those nickel hydrogenation catalysts well known and used in the hydrogenation field today. For present purposes, by nickel catalyst is meant a nickel metal content of such catalyst.

The copper chromite adjunct catalyst can be provided in supported or unsupported form. The copper chromite adjunct catalyst can be stabilized with an alkaline earth metal oxide, such as barium oxide or calcium oxide, or with a multivalent metal oxide, such as manganese oxide, although this is not essential. Typically, the oxide stabilizing material ranges from about 4% to 8% by weight of the adjunct catalyst. The molar ratio of the copper to chromite component in the adjunct catalyst also is not critical and such components can be in typical amounts heretofore conventionally used in the hydrogenation art. Typically, the molar ratio of such components is about 1:1. While the nickel catalyst and the adjunct catalyst can be simultaneously deposited on an inert carrier or provided separately in supported or unsupported form in admixture, it is only essential in the present invention that the catalyst and the adjunct catalyst both be present in the hydrogenation zone during the hydrogenation reaction.

Refractory unsaturated fatty acids generally are $C_{2-30}$ fat-forming acids and more often $C_{12-26}$ fat-forming acids, such as are typically found in vegetable oils (including nut), animal fat, fish oil, tall oil and the like. Typical vegetable oils from which the fatty acids can be derived include, for example, the oils of coconut, corn, cottonseed, linseed, olive, palm, palm kernel, peanut, safflower, soybean, sunflower, mixtures thereof and like vegetable oils. Fatty acids can be recovered from such triglyceride oil sources, for example, by conventional hydrolysis of the oils. Tall oil fatty acids also form a prime feedstock for the present process and such fatty acids can be recovered from crude tall oil by solvent fractionation techniques or conventional distillation including molecular distillation.

Feedstock unsaturated fatty acids for the present process can be separated or purified from mixtures thereof with related fatty acids and other fatty or lipoidal materials, depending in large part upon the source from which the fatty acids were derived and the particular operation employed to recover such fatty acids. Unsaturated fatty acids in admixture with relatively saturated fatty acids can be separated from such mixture by conventional distillation including molecular distillation, or by conventional fractional crystallization or solvent fractionation techniques. Alternatively and preferably, feed fatty acids for the present process can be typical in composition of the oil from which they were derived.

Depending upon the procedure utilized to recover the fatty acids for use in the present process, such fatty acids can contain a variety of contaminants and impurities which can adversely affect the hydrogenation reaction, though usually the affect is not great as the catalyst/adjunct catalyst combination is quite insensitive to most contaminants typically found in the fatty acid feed. The present process can handle fatty acids which have been derived by a variety of techniques, including splitting of fats or glyceride oils, recovery of fatty acids from crude by-product soapstock from edible oil refining, processing of crude tall oil to recover tall oil fatty acids therefrom and the like. Feedstock fatty acids need not be extensively processed prior to their entry into the hydrogenation process of this invention and advantageously need only be bleached and/or dried. It can be advantageous on occasion, though, to distill the fatty acids in order to substantially purify them. Such distilled fatty acids can be hydrogenated with extreme ease and with remarkable rapidity by the present process.

The instant hydrogenation reduces the number of ethylenic linkages in the fatty acid chains to obtain even comparative low IV materials and can be used to get practical saturation of such linkages. As practiced commercially, the hydrogenation of fatty acids is a liquid phase process in which gaseous hydrogen is dispersed in the heated fatty acid under the influence of a solid catalyst and/or catalysts. Though continuous hydrogenation methods can be practiced, most present day commercial operations employ a batch process with particulate hydrogenation catalyst, which catalyst generally is separated from the product hydrogenated fatty acid.

Hydrogenation operations for the instant process comprise charging unsaturated fatty acid into a hydrogenation reactor having a hydrogenation zone therein. Hydrogenation conditions for contacting hydrogen gas with the fatty acid typically include temperatures above about 150° C. and generally between about 150° C. and about 300° C. with advantageous temperatures being about 180° C. to about 260° C. Pressure in the hydrogenation zone should be at least about 40 psig and can range from about 40 psig to about 100 psig advantageously, though it should be expressly noted that hydrogenation pressures of up to 200 to 300 psi or greater also can be quite useful in the present process. Generally, the desired hydrogenated fatty acid product can be withdrawn from the zone after only about a few hours of residence time in the zone, though this time can vary greatly depending upon the particular feedstock and the final IV required of the product. Typical hydrogenation reactors include the hydrogen recirculation type which consists of a cylindrical vessel provided with a hydrogen distributor at the bottom through which an excess quantity of hydrogen gas is blown through the fatty acid in the hydrogenation zone. Another typical hydrogenation reactor is the dead-end system which employs a cylindrical pressure vessel with a mechanical agitator of the gas-dispersion type which is supplied from high pressure hydrogen gas storage tanks at the rate and in the volume actually used and leaked. A variety of other hydrogenation reactors are commerically employed and likewise benefically hydrogenate the fatty acid.

In the present process the total reaction is terminated when the IV of the product is determined to be within specifications for the particular product being made. The Iodine Value of the zone's contents can be determined routinely by monitoring an indicia correlative to the Iodine Value of the contents, such as refraction index measurements, ultraviolet or infrared absorption techniques, and the like.

The present hydrogenation process can be performed quite advantageously on a continuous basis. Generally, the catalysts are separated from each other and the hydrogenated fatty acid product from both catalysts by a variety of schemes. Typical schemes include holding one catalyst as a fixed bed in the hydrogenation zone while allowing the other catalyst to be freely dispersed in the fatty acid, or by providing one catalyst in supported from and the other catalyst in unsupported form for easy screening separation. A variety of other schemes can be practiced as will be obvious to those skilled in the art.

The following examples show in detail how the present invention has been practiced, but they should not be construed as limiting the scope of the present invention. In this specification all percentages and proportions are by weight, all temperatures are in degrees Centigrade, all units are in the metric system, and all catalyst weight-percentages herein are based on the weight of the fatty acid in the zone being subjected to hydrogenation, unless otherwise expressly indicated.

EXAMPLE 1

Several lots of soybean oil-derived fatty acids were hydrogenated with varying proportions of the nickel hydrogenation catalyst while holding the proportion of adjunct catalyst constant. The feed fatty acids were derived by conventional saponification of the soybean oil to form fatty acid salts followed by springing the fatty acids with mineral acid. A typical analysis of the soybean oil fatty acids is given below:

| SOYBEAN OIL FATTY ACIDS | | |
|---|---|---|
| | FATTY ACID COMPOSITION | WEIGHT-PERCENT |
| | C 6:0 | — |
| | C 8:0 | 0.1 |
| | C10:0 | — |
| | C11:0 | — |
| | C12:0 | 0.1 |
| | C13:0 | — |
| | C14:0 | 0.1 |
| | C15:0 | 0.1 |
| | C16:0 | 16.8 |
| | C16:1 | 0.1 |
| | C17:0 | — |
| iso | C18:0 | 0.1 |
| | C18:0 | 4.1 |
| | C18:1 | 12.7 |
| | C18:2 | 57.4 |
| | C18:3 | 8.3 |
| | C20:0 | — |
| | C22:0 | 0.1 |
| | Conjugated Dienes | — |
| | IV = 135.6 | |

In each run, 1300 grams of the fatty acids was charged into a 2 liter pressure vessel equipped with a variable speed stirred agitator and fitted with a pressure gauge and electrical heater. The fatty acids and catalyst system were charged into the vessel, the vessel evacuated of air and its contents preheated to 100° C. All hydrogenation runs were conducted at about 220° C. at a hydrogen gas pressure of 60 psig, such conditions being those normally reserved for glyceride oil hydrogenation. The nickel hydrogenation catalysts were fully active nickel on a support and protected in stearine (NYSEL HK-4 nickel catalyst supplied by Harshaw Chemical Company, Cleveland, Ohio, NYSEL being a registered trademark). The adjunct catalyst were copper chromite (about 1:1 molar ratio of copper content to chromium content) stabilized with about 7–8% of barium oxide (Code 102 copper chromite catalyst supplied by Calsicat Division of Mallinckrodt, Inc.)

In each of the runs, the proportion of adjunct catalyst was 1.0% while the nickel catalyst was 0.025% in Run 1, 0.10% in Run 2, and 0.15% in Run 3. The results obtained are displayed below in Table 1.

TABLE 1

| HYDROGENATION TIME (Hours) | RUN 1 (IV) | RUN 2 (IV) | RUN 3 (IV) |
|---|---|---|---|
| 0 | 135.6 | 135.6 | 135.6 |
| 1 | 85.5 | 25.9 | 22.4 |
| 2 | 70.9 | 8.1 | 4.9 |
| 2.5 | — | — | 1.9 |
| 3 | — | 1.6 | — |
| 7 | 52.7 | — | — |

The foregoing results show that at remarkably low levels of nickel (0.025% in Run 1) the fatty acids can be hydrogenated to a suitable shortening-like consistency (IV of around 70) in but a couple of hours under relatively mild hydrogenation conditions. Increasing the level of nickel catalyst to the moderate levels in Runs 2 and 3 permits relatively complete hydrogenation (IV of less than 10) in just a couple of hours under the same mild hydrogenation conditions. These results are especially surprising considering the use of the copper chromite adjunct catalyst which does not even strongly catalyze glyceride oil hydrogenations.

When Run 2 (0.1% Nickel/1.0% adjunct catalyst) was repeated on a lot of the soybean oil fatty acids which has been distilled, it was found that virtually complete hydrogenation (IV of 0) was obtained after about 1 hour of reaction time under the same mild hydrogenation conditions. It should be noted that when the procedure of these runs was repeated using 1.1% nickel catalyst alone (a massive amount of nickel far above that permitted in commercial oil refineries) that the IV of the fatty acids was reduced to just below 10 in around an hour, but that substantial inseparable nickel salts were formed (about 0.22%) which turned the hydrogenated fatty acids dark green in color and caused a substantial loss in the amount of fatty acids product by degradation thereof. This problem was not experienced in the runs conducted according to the present invention.

EXAMPLE 2

While relatively mild conditions generally will suffice for the present invention, it can be helpful on occasion to increase the hydrogen pressure to higher levels and such is within the contemplation of the present invention. The procedure of Run 1 in Example 1 was repeated except that the hydrogen pressure was increased to 300 psi. The results obtained are displayed in Table 2 below:

TABLE 2

| HYDROGENATION TIME (Hours) | IODINE VALUE |
|---|---|
| 0 | 135.6 |
| .5 | 82.6 |
| 1.0 | 61.8 |
| 1.5 | 52.2 |
| 2.0 | 45.3 |
| 2.5 | 43.0 |
| 3.0 | 40.9 |
| 5 | 32.6 |

Again, the speed and efficiency of the present process is demonstrated.

EXAMPLE 3

The procedure of Example 2 was repeated using 0.1% nickel and 1.0% copper chromite for a batch of coconut oil derived fatty acids. Lauric fatty acids are very difficult to hydrogenate because they have such a low IV naturally (broadly about 10–30). The composition of the coconut fatty acids is given below:

| COCONUT OIL FATTY ACIDS | | |
|---|---|---|
| | FATTY ACID COMPOSITION | WEIGHT-PERCENT |
| | C 6:0 | 0.1 |
| | C 8:0 | 6.1 |
| | C10:0 | 5.3 |
| | C11:0 | — |
| | C12:0 | 44.1 |
| | C13:0 | — |
| | C14:0 | 19.2 |
| | C15:0 | — |
| | C16:0 | 10.9 |
| | C16:1 | — |
| | C17:0 | — |
| iso | C18:0 | — |
| | C18:0 | 3.1 |
| | C18:1 | 9.0 |
| | C18:2 | 2.4 |
| | C18:3 | — |
| | C20:0 | — |
| | IODINE VALUE OF 11.8 | |

The results of the hydrogenation run is given in Table 3 below.

TABLE 3

| HYDROGENATION TIME (Hours) | IODINE VALUE |
|---|---|
| 0 | 11.8 |
| .25 | 1.8 |
| .50 | 0 |

The remarkable speed and efficiency of the present process clearly is proven in the above-tabled results.

EXAMPLE 4

The feed fatty acids were derived from aqueous crude soapstocks which had been subjected to a saponification/acidulation treatment for recovery of the fatty acid contents thereof. Fatty acid recovery from soapstock can be found in commonly assigned U.S. Ser. No. 810,518, filed June 27, 1977, the same expressly incorporated herein by reference. Since crude soapstocks are by-products of alkali refining of glyceride oils, such soapstocks generally can contain higher proportions of contaminants than fatty acids derived directly from glyceride oils. Typical of such contaminants are water, phosphatides, unsaponifiables, soaps and the like.

A series of hydrogenation runs was conducted according to the procedure of Example 1 using 0.1% nickel catalyst and 1.0% adjunct catalyst and hydrogenation conditions of 60 psi hydrogen pressure and 200°–220° C. hydrogenation temperature. The soybean oil fatty acids in Runs 1 and 2 below have a composition representative of the soybean fatty acids in Example 1. The soybeam fatty acids in Run 1 were dried only while those in Run 2 were additionally distilled. The feed for Run 3 was a lot of palm kernel fatty acids having a composition as given below.

| PALM KERNEL FATTY ACIDS | | |
|---|---|---|
| | FATTY ACID COMPOSITION | WEIGHT-PERCENT |
| | C 6:0 | 0.1 |
| | C 8:0 | 3.1 |
| | C10:0 | 3.2 |
| | C11:0 | — |
| | C12:0 | 46.3 |
| | C13:0 | — |
| | C14:0 | 16.2 |
| | C15:0 | — |
| | C16:0 | 10.2 |
| | C16:1 | — |
| | C17:0 | — |
| iso | C18:0 | — |
| | C18:0 | 2.8 |
| | C18:1 | 15.6 |
| | C18:2 | 2.4 |
| | C18:3 | — |
| | C20:0 | — |
| | C22:0 | — |
| | IODINE VALUE OF 15.1 | |

The results of these hydrogenation runs are given in Table 4 below.

| HYDROGENATION TIME (Hours) | RUN 1 (IV) | RUN 2 (IV) | RUN 3 (IV) |
|---|---|---|---|
| 0 | 135.6 | 126 | 15.1 |
| 1.0 | — | 55.8 | 4.3 |
| 1.5 | — | 43.6 | 2.3 |
| 2.0 | — | 34.7 | — |
| 3.0 | — | 24.8 | — |
| 7.0 | 9.4 | — | — |

The above-tabled results demonstrate that even fatty acids recovered from crude soapstock can be effectively hydrogenated by the present process. The results of Run 2 show that some improvements in the process may be had by using a distilled fatty acid feed. The results of Run 3 show the particularly good activity of the catalyst/adjunct catalyst in hydrogenating lauric fatty acids under mild hydrogenation conditions.

EXAMPLE 5

A hydrogenation run was conducted according to the procedure of Example 1 using 0.025% nickel catalyst and 1.0% adjunct catalyst on a lot of tall oil derived fatty acids which had been processed to the following composition.

| TALL OIL FATTY ACIDS | | |
|---|---|---|
| | FATTY ACID COMPOSITION | WEIGHT-PERCENT |
| | C 8:0 | 0.1 |
| | C10:0 | 0.1 |
| | C12:0 | 0.8 |
| | C14:0 | 2.2 |
| | C15:0 | 0.1 |
| iso | C16:0 | 0.1 |
| | C16:0 | 82.4 |
| | C16:1 | 1.6 |
| iso | C18:0 | 0.3 |
| | C18:0 | 0.2 |
| | C18:1 | 2.1 |
| | C18:2 | 4.7 |
| | IODINE VALUE OF 12.2 | |

Hydrogenation conditions included 60 psi hydrogen pressure and 215° C. reaction temperature. The results obtained are given in Table 5 below:

TABLE 5

| HYDROGENATION TIME (Hours) | IODINE VALUE |
|---|---|
| 0 | 12.2 |
| 1.5 | 5.4 |
| 2.75 | 4.8 |
| 3.25 | 2.8 |

Again, the efficiency of the present process is demonstrated.

EXAMPLE 6 Hydrogenation runs were conducted according to the procedure of Example 1 on various feedstocks detailed below under hydrogenation conditions of 60 psi hydrogen pressure and 220° reaction temperature. The fatty acids were a mixture of soybean and cottonseed derived fatty acids known as SYLFAT V16R (Run 1) and V16B (Run 2), SYLFAT being a registered trademark of SYLVACHEM CORPORATION, Jacksonville, Florida. These fatty acid feeds had the following analysis.

| | FATTY ACID COMPOSITION | RUN 1 (wt-%) | RUN 2 (wt-%) |
|---|---|---|---|
| | C 8:0 | — | 0.1 |
| | C10:0 | — | 0.1 |
| | C12:0 | 0.9 | 0.9 |
| | C14:0 | 2.3 | 2.4 |
| | C15:0 | 0.1 | 0.2 |
| iso | C16:0 | — | 0.1 |
| | C16:0 | 88.7 | 88.8 |
| | C16:1 | 1.5 | 1.6 |
| | C17:0 | — | 0.1 |
| iso | C18:0 | 0.1 | 0.1 |
| | C18:0 | Trace | Trace |
| | C18:1 | 2.0 | 1.9 |
| | C18:2 | 4.4 | 3.7 |
| | IODINE VALUE | 10.8 | 9.6 |

The results of the hydrogenation runs are given in Table 6 below.

TABLE 6

| HYDROGENATION TIME (Hours) | RUN 1 (IV) | RUN 2 (IV) |
|---|---|---|
| 0 | 10.8 | 9.6 |
| 1 | — | 3.1 |
| 2.5 | 2.3 | — |

Fatty acids having low IVs are the most difficult to hydrogenate since comparatively few sites of unsaturation are present. As the foregoing results demonstrate, the present process handles such fatty acids remarkably well and efficiently.

I claim:

1. A process for the hydrogenation of an unsaturated fatty acid which comprises:

subjecting said fatty acid to hydrogenation in a hydrogenation zone with hydrogen gas under hydrogenation conditions comprising a temperature of at least about 150° C. and a gauge pressure of at least about 40 psi in the presence of about 0.025 to about 0.3 weight-percent nickel hydrogenation catalyst and of about 0.5 to about 3 weight-percent copper chromite adjunct catalyst; and withdrawing resulting hydrogenated fatty acid from said zone.

2. The process of claim 1 wherein said unsaturated fatty acid is a glyceride oil-derived fatty acid.

3. The process of claim 1 wherein said unsaturated fatty acid is a tall oil-derived fatty acid.

4. The process of claim 1 wherein said fatty acid is a $C_{2-30}$ fatty acid.

5. The process of claim 4 wherein said fatty acid is a $C_{12-20}$ *fatty acid.*

6. The process of claim 1 wherein said resulting hydrogenated fatty acid has an Iodine Value of not substantially above about 100.

7. The process of claim 6 wherein the Iodine Value is between about 60 and 80.

8. The process of claim 6 wherein said Iodine Value is not substantially above about 30.

9. The process of claim 1 wherein said temperature is between about 150° C. and about 300° C. and said gauge pressure is between about 40 psi and about 300 psi.

10. The process of claim 9 wherein said temperature is between about 180° C. and about 260° C. and said gauge pressure is between about 40 psi and about 100 psi.

11. The process of claim 1 wherein said adjunct catalyst is metal oxide stabilized.

12. The process of claim 11 wherein said metal oxide is barium oxide or manganese oxide.

13. The process of claim 1 wherein said fatty acid is admitted continuously into said hydrogenation zone and said resulting hydrogenated fatty acid is continuously withdrawn from said zone.

14. The process of claim 13 wherein an indicia correlative to said Iodine Value of the fatty acid in said zone is monitored continuously near an outlet in said zone and at least one adjustable hydrogenation condition of said monitored zone is adjusted in response to variation of said indicia and to a degree adequate for maintaining said indicia, thus the corresponding Iodine Value of the contents of said monitored zone, substantially constant.

* * * * *

UNITED STATES PATENT AND TRADEMARK OFFICE

CERTIFICATE OF CORRECTION

PATENT NO. : 4,133,822

DATED : Jan. 9, 1979

INVENTOR(S) : John M. Hasman

It is certified that error appears in the above-identified patent and that said Letters Patent are hereby corrected as shown below:

Column 4, line 48, change "from" to --form--.

Column 7, line 32, change "soybeam" to --soybean--.

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*